US006652168B2

(12) United States Patent
Hyodo

(10) Patent No.: US 6,652,168 B2
(45) Date of Patent: Nov. 25, 2003

(54) PHOTOSENSITIVE MATERIAL PROCESSOR

(75) Inventor: Tomoyoshi Hyodo, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/242,769

(22) Filed: Sep. 13, 2002

(65) Prior Publication Data

US 2003/0053808 A1 Mar. 20, 2003

(30) Foreign Application Priority Data

Sep. 14, 2001 (JP) ..... 2001-279208

(51) Int. Cl.[7] ..... G03D 3/02; G03D 3/08

(52) U.S. Cl. ..... 396/620; 396/622; 396/626; 396/636

(58) Field of Search ..... 396/612, 617, 396/620, 626, 636, 641, 622; 355/27–29; 134/64 P, 64 R, 122 P, 122 R

(56) References Cited

U.S. PATENT DOCUMENTS 4,980,714 A * 12/1990 Nakamura et al. ..... 396/622
5,108,878 A * 4/1992 Nakamura ..... 396/626
5,799,224 A * 8/1998 Verlinden et al. ..... 396/622

FOREIGN PATENT DOCUMENTS

JP 4-104147 * 6/1992
JP 9-133992 * 5/1997

* cited by examiner

*Primary Examiner*—Della J Rutledge
(74) *Attorney, Agent, or Firm*—Birch, Stewart, Kolasch & Birch, LLP

(57) ABSTRACT

A device for processing a photosensitive material using processing solution includes, processing chambers for storing processing solution therein, at least one of the processing chambers being lower than another processing chamber, a bypass for placing each processing chamber that is downstream of another processing chamber relative to conveyance direction of the photosensitive material in fluid communication with the another processing chamber to pass the processing solution therethough, and a check valve disposed at each bypass for allowing the processing solution which flows from the processing chamber disposed downstream relative to conveyance direction of the photosensitive material to the another processing chamber, and for preventing the processing solution from flowing from the another processing chamber to the downstream processing chamber. The valve body of the check valve, which has a specific gravity different from a specific gravity of the processing solution, is urged against the valve seat by buoyant force.

18 Claims, 9 Drawing Sheets

PHOTOSENSITIVE MATERIAL PROCESSOR

BACKGROUND OF THE INVENTION

1. Field of the Invention

The present invention relates to a photosensitive material processor for processing a photosensitive material by immersing the photosensitive material in a processing solution in a processing tank. In particular the invention relates to a photosensitive material processor causing a replenisher to overflow stably and sequentially in continuous processing chambers for processing, being able to maintain stable performance and process the photosensitive material rapidly.

2. Description of the Related Art

A photosensitive material, for example, a color paper, is processed through processes such as color development, bleach-fixing, washing and the like after exposure.

A color developer is used for color development, a bleach-fixing solution is used for bleach-fixing and tap water or ion exchanged water is used for washing.

These processes are usually performed by a photosensitive material processor such as an automatic developer.

An automatic developer is ordinarily provided with a color development tank, a bleach-fixing tank, and a plurality (about four) of washing tanks, and a so-called cross-over type developer is common. When conveying a photosensitive material from a processing tank to the next processing tank, the automatic developer takes out the photosensitive material once from the processing tank and conveys the photosensitive material through the air to the next tank.

In recent years, there has been a desire by the marketplace for quick processing of photosensitive material, and a photosensitive material processor of a type that sequentially transports the photosensitive material through a plurality of processing tanks without conveying the photosensitive material through the air has been proposed.

An example of the type of photosensitive material processor that sequentially transports the photosensitive material through a plurality of processing tanks in Japanese Patent Laid-Open (JP-A) No. 9-015812. In FIG. 4 of this publication, a type of a photosensitive material processor including a plurality of washing tanks arranged vertically and horizontally which allows the photosensitive material to pass through the plurality of washing tanks in sequentially, is shown.

On each partition wall of adjacent tanks in the conveyance direction of the photosensitive material, a slit-shaped passage equipped with a blade made from an elastic material is provided. The photosensitive material is conveyed to the washing tank that is downstream by deforming the blade elastically. The slit-shaped passage is arranged to be closed by the blade after the photosensitive material has passed.

However, in the photosensitive material processor disclosed in JP-A No. 9-015812, there is no opening that contacts the air or free water surface. Thus, a so-called cascade, in which the washing water flows in a counterflow, which is opposite to the flow of the photosensitive material processing, by an overflow, cannot be performed as it can in existing washing tanks. Consequently, it is necessary to arrange a plurality of water pumps to pump washing water to each washing tank sequentially. This complicates construction of the photosensitive material processor and increases the cost thereof.

Another photosensitive material processor, which is able to reduce the number of pumps by disposing a bypass between processing tanks, is disclosed in U.S. Pat. No. 6,071,020.

However, a washing solution in a first chamber of the washing tank, which is upstream relative to the processing direction, is the dirtiest and has the highest specific gravity because of adherent solutions (such as a fixing solution) being brought into the first chamber by the photosensitive material to be processed.

As a result, in the bypass in which solution always continues as disclosed in U.S. Pat. No. 6,071,020, a purpose thereof is achieved when the photosensitive material is processed continuously. However it has been found that an unfavorable back flow occurs from the difference in the specific gravity of the washing solutions when processing of the photosensitive material stops.

SUMMARY OF THE INVENTION

The present invention has been made to solve the foregoing problems, and an object of the invention is to provide a photosensitive material processor having a simple construction and capable of quick processing without back flow of the processing solution occurring.

A first aspect of the invention is a device for processing a photosensitive material using processing solution, the device comprising: a plurality of processing chambers for storing processing solution therein, at least one of the processing chambers being lower than another processing chamber, paths connecting each processing chamber to another, a blade disposed at the path for permitting the photosensitive material to pass along the path by deforming resiliently and for inhibiting passage along the path of the processing solution in the processing chamber when the photosensitive material is not passing, a conveyance mechanism for conveying the photosensitive material through the processing chambers, a replenishment device for replenishing the processing solution, in accordance with a processed quantity of the photosensitive material, to at least one processing chamber that is downstream of another chamber relative to conveyance direction of the photosensitive material, a bypass for placing each processing chamber that is downstream of another processing chamber relative to conveyance direction of the photosensitive material in fluid communication with the another processing chamber for passage of the processing solution therethough, and a check valve disposed at each bypass for allowing the processing solution which flows from the processing chamber that is downstream relative to conveyance direction of the photosensitive material to the another processing chamber, and for preventing the processing solution from flowing from the another processing chamber to the downstream processing chamber, the check valve comprising a valve seat and a valve body, the valve body has a specific gravity different from a specific gravity of the processing solution and is urged against the valve seat by a force generated by the difference of specific gravity between the valve body and the processing solution.

In above arrangement of the photosensitive material processor, the photosensitive material is conveyed sequentially through the in a plurality of processing chambers by the conveying device and processed by the processing solution of each processing chamber while being conveyed.

When the photosensitive material is conveyed to the next processing chamber, a leading edge portion of the photosensitive material deforms elastically the blade by abutting on the blade. Thus, the photosensitive material can enter into the next processing chamber through the narrow path.

The photosensitive material contacts the blade and slides while being conveyed, which prevents the processing solution on the upstream side adhered on the photosensitive material from entering into the processing chamber on the downstream side.

Furthermore, the blade inhibits passage of the processing solution when the photosensitive material is not being conveyed.

A replenishment device replenishes the processing solution in the processing chamber that is downstream relative to conveyance direction of the photosensitive material according to processing quantity of the photosensitive material (namely, deterioration of the processing solution).

By replenishing of the processing solution in the processing chamber that is downstream relative to conveyance direction of the photosensitive material, the processing solution is replenished via bypass in the processing chamber that is upstream relative to conveyance direction of the photosensitive material.

The valve body is urged against the valve seat with the force generated by the difference in specific gravity between the processing solutions. However, the flow of the processing solution from the replenishment is not prevented because the valve body is separated from the valve seat with pressure generated by forcedly replenishing of the processing solution.

On the other hand, when the processing solution is not being supplied, the valve body is urged against the valve seat with the force generated by the difference in the specific gravity between the processing solution and the valve body. Thus, the bypass closes to prevent the back flow of the processing solution.

The specific gravity of the processing solution in the upper processing chamber that is upstream relative to conveyance direction of the photosensitive material may become larger, because of another processing solution being brought into this processing chamber adhering to the photosensitive material, than the specific gravity of the processing solution in the lower processing chamber that is downstream relative to conveyance direction of the photosensitive material. However, even in this case, because there is the difference in the specific gravity between the valve body and the processing solution, the valve body is urged against to the valve seat with the force generated by the difference in the specific gravity to close the bypass.

Consequently, the processing solution having larger specific gravity that is upstream relative to conveyance direction of the photosensitive material, namely, the waste processing solution, never flows into the processing chamber that is downstream relative to conveyance direction of the photosensitive material.

In the first aspect, when replenishing the processing solution, A is specific gravity of the valve body disposed at the bypass through which the processing solution flows upward and B is specific gravity of the processing solution stored in the processing chamber that is upstream of the bypass relative to conveyance direction of the photosensitive material, whereas A/B is set to be at least 1 and less than 1.5.

In above described arrangement of the photosensitive material processor, the processing solution stored in the processing chamber that is upstream relative to conveyance direction of the photosensitive material tends to flow downward in the bypass in which the processing solution can flow upward when supplying the processing solution. Consequently, the specific gravity of the valve body is set to be larger than that of the processing solution. When the processing solution is not supplied, the valve body sinks in the processing solution so that a force (opposite to a buoyancy force) can be generated by the sinking, by which force the valve body closes the bypass.

The reason why A/B is at least 1 and less than 1.5 is that, when A/B is not lower than 1.5, the force closing the bypass becomes larger but the valve body does not move unless a large difference in pressure is given when replenishing the processing solution, which prevents the processing solution from being replenished to the processing chamber that is upstream relative to conveyance direction of the photosensitive material.

Further, in the first aspect, when replenishing the processing solution, A is specific gravity of the valve body disposed at the bypass through which the processing solution flows downward and B is specific gravity of the processing solution stored in the processing chamber that is upstream of the bypass relative to conveyance direction of the photosensitive material, whereas A/B is set to be at least 0.8 and less than 1.

In above described arrangement of the photosensitive material processor, the specific gravity of the valve body is set to be smaller than that of the processing solution. When the processing solution is not supplied, the valve body floats in the processing solution so that a force (buoyancy) can be generated by floating, which force causes the valve body to close the bypass.

The reason why A/B is at least 0.8 is that, when A/B is less than 0.8, the force closing the bypass becomes larger but the valve body does not move unless a large difference in pressure is given when replenishing the processing solution, which prevents the processing solution from being replenished to the processing chamber that is upstream relative to conveyance direction of the photosensitive material.

Furthermore, in the first aspect, the valve body includes a rotatable mechanism rotated by the processing solution flowing near the valve body.

When the specific gravity of the processing solution in the processing chamber that is above becomes larger than that of the processing solution in the processing chamber that is below, the processing solution in the upper processing chamber begins to flow to the lower processing chamber via the bypass, the valve body must stop the flow of the processing solution. However, because the force generated by the difference in the specific gravity and moves the valve body is small, it is possible that the valve body will become caught in the bypass and not move.

However, in the above described arrangement of the photosensitive material processor, because the valve body is rotated with a rotating force generated by the flow of the processing solution near the valve body there is no risk of the valve body becoming caught in the bypass and not closing the bypass.

Moreover, in the first aspect, the bypass is a through hole formed in a partition separating the processing chamber that is downstream relative to conveyance direction of the photosensitive material from the processing chamber that is upstream relative to conveyance direction of the photosensitive material.

It is not necessary to install a pipe or the like outside of the processing chambers because the bypass is the through hole in the partition separating the processing chamber that is downstream relative to conveyance direction of the photosensitive material from the processing chamber that is upstream relative to conveyance direction of the photosensitive material. As a result, the number of parts of the photosensitive material processor does not increase and the cost can be held down.

A second aspect of the invention, is a device for processing a photosensitive material using processing solution, the device comprising: a plurality of processing chambers for storing processing solution therein, at least one of the processing chambers being lower than another processing chamber, paths connecting each processing chamber to another, a blade disposed at the path for permitting the photosensitive material to pass along the path by deforming resiliently and for inhibiting passage along the path of the processing solution in the processing chamber when the photosensitive material is not passing, a conveyance mechanism for conveying the photosensitive material through the processing chambers, a replenishment device for replenishing the processing solution, in accordance with a processed quantity of the photosensitive material, to at least one processing chamber that is downstream of another chamber relative to conveyance direction of the photosensitive material, a bypass for placing each processing chamber that is downstream of another processing chamber relative to conveyance direction of the photosensitive material in fluid communication with the another processing chamber to pass the processing solution therethough, and a check valve disposed at each bypass for allowing the processing solution to flow from the processing chamber that is downstream relative to conveyance direction of the photosensitive material to the another processing chamber, and for preventing the processing solution from flowing from the another processing chamber to the downstream processing chamber, wherein the plurality of processing chambers is disposed such that the photosensitive material is conveyed downwards through at least one of the processing chambers that is lower after being conveyed through the another processing chamber and then is conveyed upward through at least one other processing chamber higher than the lower chamber, the check valve disposed between the processing chambers, through which the photosensitive material is conveyed from the higher to the lower processing chamber, comprises a valve seat and a valve body, the valve seat being disposed under the valve body, the valve body having a specific gravity greater than a specific gravity of the processing solution and being urged against the valve seat by a force generated by the difference in specific gravity between the valve body and the processing solution; and the check valve being disposed between the processing chambers through which the photosensitive material is conveyed from the lower to the higher processing chamber, comprises a valve seat and a valve body, the valve seat being disposed above the valve body, the valve body having a specific gravity less than a specific gravity of the processing solution and being urged against the valve seat by a force generated by the difference in specific gravity between the valve body and the processing solution.

In above arrangement of the photosensitive material processor, the photosensitive material is conveyed sequentially through the plurality of processing chambers by the conveying device and processed by the processing solution of each processing chamber while being conveyed.

When the photosensitive material is conveyed to the next processing chamber, a leading edge portion of the photosensitive material deforms elastically the blade by abutting on the blade. Thus, the photosensitive material can enter into the next processing chamber through the narrow path.

The photosensitive material contacts the blade and slides while being conveyed, which prevents the processing solution on the upstream side adhered on the photosensitive material from entering into the processing chamber on the downstream side.

Furthermore, the blade inhibits passage of the processing solution when the photosensitive material is not being conveyed.

In a normal case, namely, when the processing solution is not being supplied, in the check valve provided between the processing chambers through which the photosensitive material is conveyed from the above to the below, the valve body is urged against to the valve seat there below with the force generated by the difference in specific gravity between the valve body and the processing solution to close the bypass because the specific gravity of the valve body is larger than that of the processing solution.

On the other hand, in the check valve provided between the processing chambers which the photosensitive material is conveyed from below to above, the valve body is urged against to the valve seat thereabove with the force generated by the difference in specific gravity between the valve body and the processing solution to close the bypass because the specific gravity of the valve body is smaller than that of the processing solution.

As the processing progresses, the specific gravity of the processing solution in the upper processing chamber that is upstream in the conveyance direction of the photosensitive material may become larger than the specific gravity of the processing solution in the lower processing chamber that is downstream in the conveyance direction of the photosensitive material because of another processing solution being brought into this upstream processing chamber by adhering to the photosensitive material. However, even in this case, because there is the difference in the specific gravity between the valve body and the processing solution, the valve body is urged against the valve seat with the force generated by the difference in the specific gravity, keeping the bypass closed.

Consequently, even in the case in which the processing chamber, which contains the processing solution that is dirty and has larger specific gravity, is disposed above the processing chamber, which is upstream relative to conveyance direction of the photosensitive material and contains the processing solution that is less dirty and has smaller specific gravity, the processing solution, which is dirty and has the larger specific gravity does not flow into the processing chamber disposed on the lower side that is downstream relative to conveyance direction of the photosensitive material.

The supplying device supplies the processing solution to the processing chamber that is downstream relative to conveyance direction of the photosensitive material according to the processed quantity of the photosensitive material (namely, deterioration of the processing solution).

If the processing solution is replenished to the processing chamber that is downstream relative to conveyance direction of the photosensitive material, the valve body is separated from the valve seat with the pressure generated by the replenishment. Thus, the flow of the processing solution by the replenishment is not prevented.

Accordingly, the processing solution is replenished to the processing chamber that is upstream relative to conveyance direction of the photosensitive material through the bypass.

DESCRIPTION OF THE PREFERRED EMBODIMENT

A photosensitive material processor according to an embodiment of the present invention will be described with reference to FIG. 1 to FIG. 8.

Figure 2:
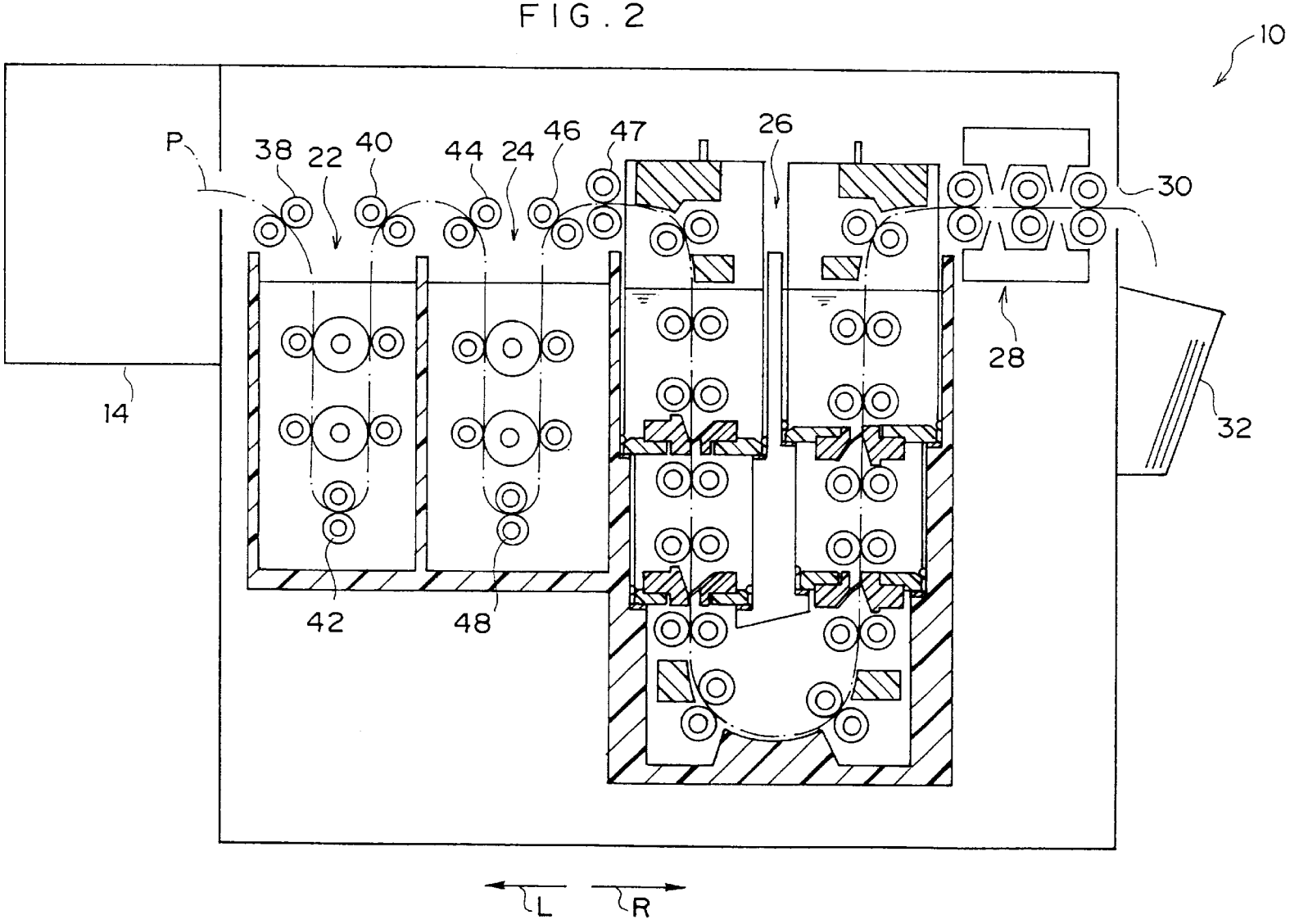
FIG. 2 is a cross-sectional view of a photosensitive material processor along the conveyance direction of the photosensitive material according to the embodiment of the invention.

As shown in FIG. 2, a photosensitive material processor 10 in the embodiment of the invention is provided with a feed portion 14 feeding exposed paper P as a photosensitive material at the side in an arrow L direction.

A color developing agent tank 22 for storing color developing agent, a bleach-fixing tank 24 for storing bleach-fixer, a washing tank 26 storing washing water and a dryer 28 for drying the paper P with warm air are provided in sequence in an arrow L direction from the feed portion 14.

A side wall in the direction of arrow R of the feed portion 14 is provided with an outlet port 30 for discharging the paper P finished drying and product stocking portion 32 for receiving the discharged paper P.

(Color Developing Agent Tank)

As shown in FIG. 2, a conveyance roller 38 that conveys the paper P into the color developing agent tank 22 and a conveyance roller 40 that conveys the paper P processed in the color development to the bleach-fixing tank 24 are provided above the color developing agent tank 22. A conveying device 42 having a plurality of rollers which convey the paper P in the tank in a substantially U-shape is provided in the color developing agent tank 22.

Examples of components of replenisher for color development includes, 4-amino-3-methyl-N-ethyl-[β (methansulfonamide)ethyl]aniline sulfate, polyethylene glycol, N-sodium lauroylalanine, disulfoethylhydroxylamine di-sodium chloride salt, Tipanol SFP (a product of Ciba-Geigy Corporation), sodium sulfite, potassium bromide, diethylenetriamine penta-acetic acid salt, sodium p-toluenesulfonate, potassium hydrate, mannitol, and potassium carbonate. The replenisher may also comprise components other than above.

(Bleach-fixing Tank)

A conveyance roller 44 that conveys the paper P into the bleach-fixing tank 24 and a conveyance roller 46 that conveys the paper P that was processed in the bleach-fixing to the washing tank 26 are provided above the bleach-fixing tank 24. A conveying device 48 having a plurality of rollers which conveys the paper P in the tank in a substantially U-shape is provided in the bleach-fixing tank 24.

Examples of components of replenisher for bleach-fixing include, ammonium salt monohydrate of diethylenetriamine penta-acetate ferrite complex, ethylenediamine tetra-acetic acid salt, maleic acid, Pineflow (a product of Matsutani Chemical Industry Co., Ltd.), N-lauroyl sarcosine sodium salt, ammonium thiosulfate, sodium sulfite, potassium bromide, and p-toluenesulfinic acid. The replenisher may also comprise components other than above.

(Washing Tank 26)

Figure 1:
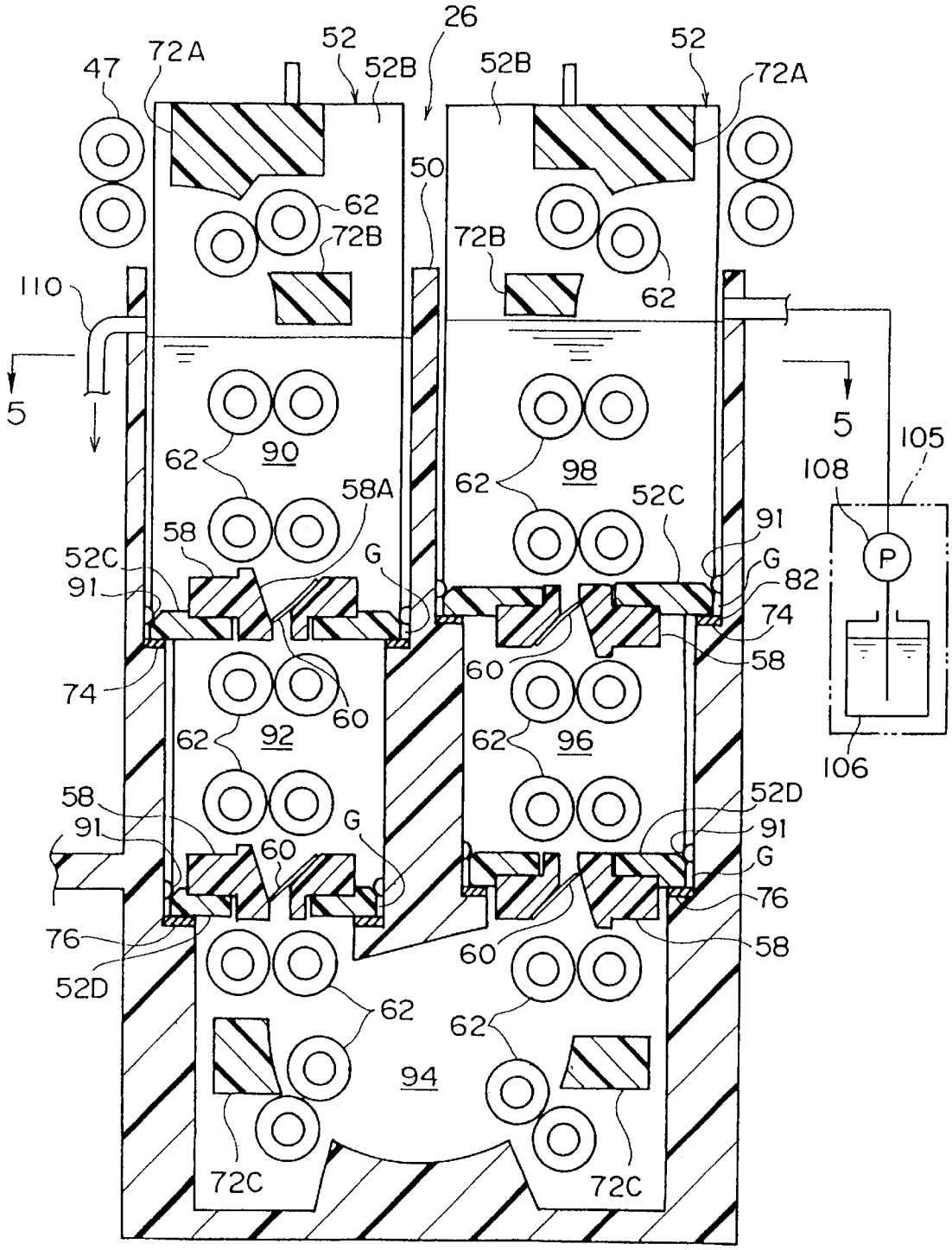
FIG. 1 is a cross-sectional view of a washing tank along conveyance direction of a photosensitive material according to an embodiment of the present invention.
Figure 3:
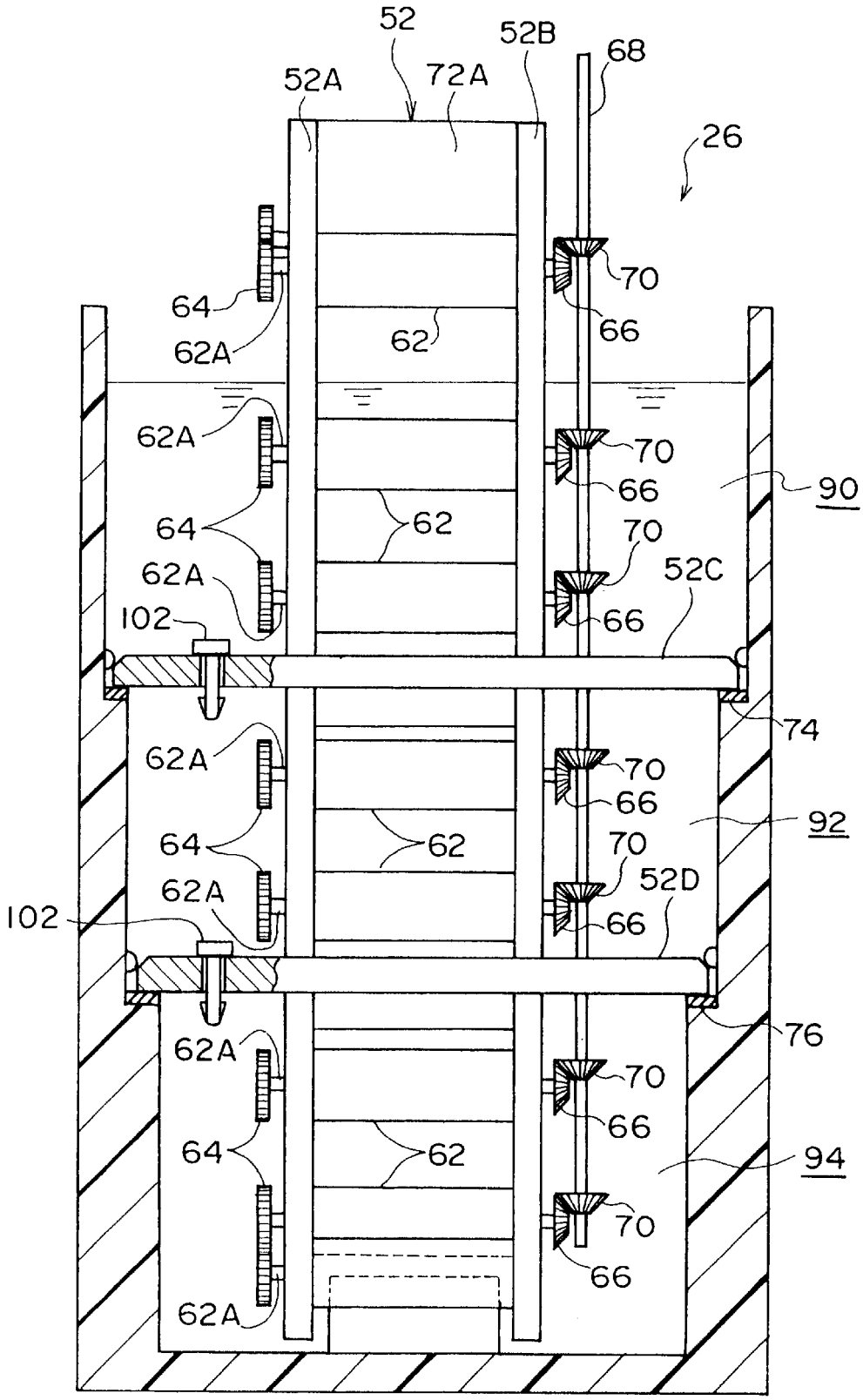
FIG. 3 is a cross-sectional view of the first to third processing chambers in a washing tank.
Figure 4:
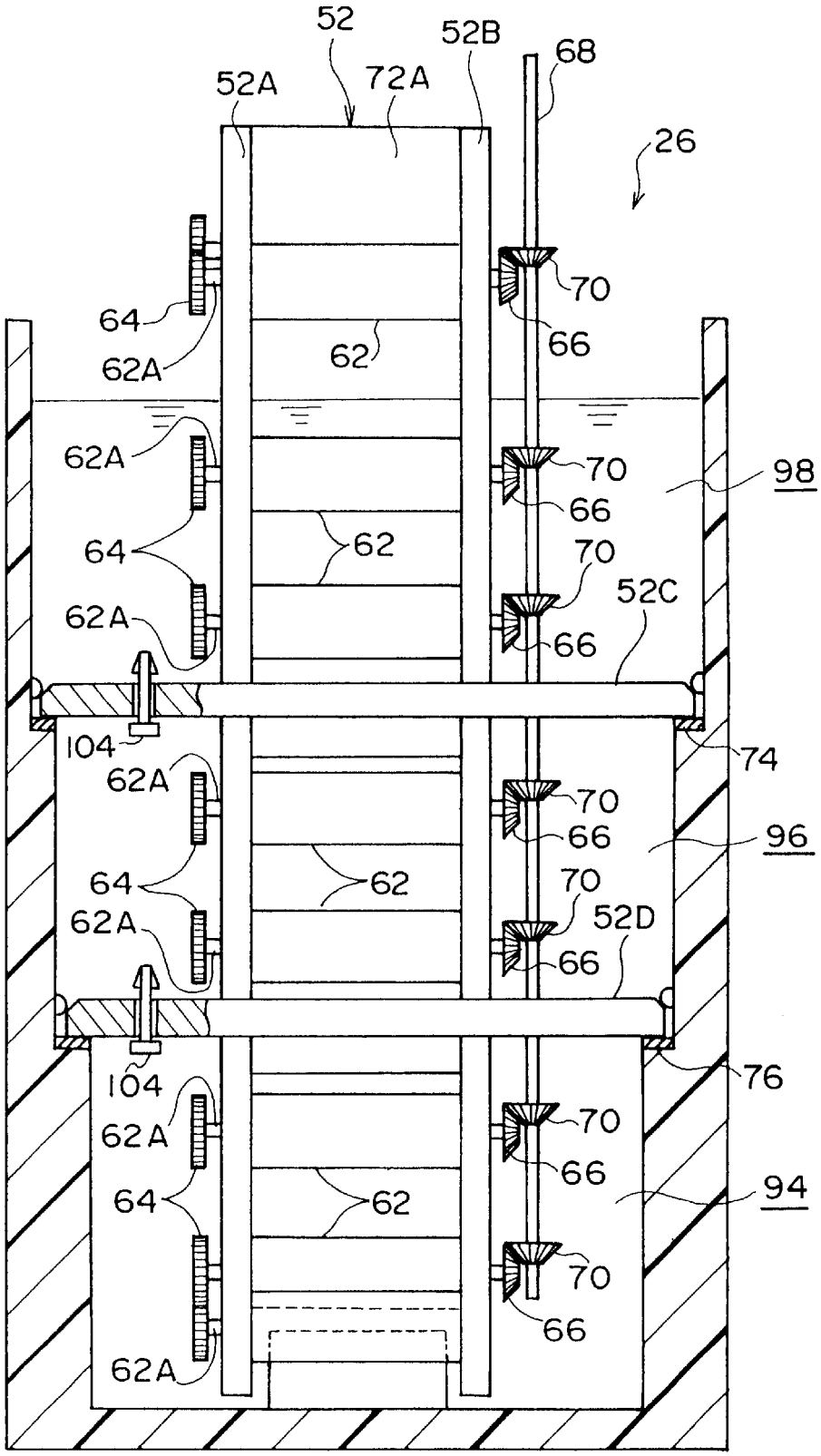
FIG. 4 is a cross-sectional view of the third to fifth processing chambers in the washing tank.

As shown in FIG. 1, FIG. 3 and FIG. 4, a washing tank 26 is formed to extend upward, and the upper portion thereof is open.

A partition 50 that divides the washing tank 26 into an upstream side and a downstream side, relative to conveyance direction of the paper P, is provided inside the washing tank 26 except for a part of a bottom side thereof.

Partition members 52 are each detachably inserted from the upper portion into the washing tank 26 on the upstream side and the downstream side of the partition 50.

The partition member 52 includes a vertical wall 52A and a vertical wall 52B which are parallel to each other and extend in the vertical direction, and a side wall 52C and a side wall 52D which connect the vertical wall 52A with the vertical wall 52B and extend in the horizontal direction.

A block-shaped blade support member 58 is attached to a central portion of each of the side walls 52C and the side wall 52D.

A slit hole 58A through which the paper P passes is formed in the blade support member 58. The slit hole 58A expands upstream relative to the conveyance direction and tapers in a substantial v-shape.

A base of a blade 60, which is made from an elastic material, is attached to one internal surface of the slit hole 58A, and an edge of the blade 60 is contacted elastically with the other internal surfaces when the photosensitive material is not passing through the slit hole 58A.

The partition member 52 is provided with three pairs of rollers 62 above the side wall 52C, two pairs of rollers 62 between the side wall 52C and the side wall 52D and two pairs of rollers 62 below the side wall 52D.

In these pairs of rollers, shafts 62A penetrate through the vertical wall 52A and the vertical wall 52B and are rotatably supported.

A gear 64 is attached to an end of each shaft 62A, which end projects from the vertical wall 52A. The gear 64 attached to one of the shafts 62A in the pair of rollers 62 engages the gear 64 attached to the other shaft 62A.

On the other side, a bevel gear 66 is attached to an end of one of the shafts 62A in the pair of rollers, which end 62 projects from the vertical wall 52B.

A main shaft 68 that extends in the vertical direction is supported by the side wall 52C and the side wall 52D outside of the vertical wall 52B.

A bevel gear 70, which engages the bevel gear 66 of the shaft 62A, is attached to the main shaft 68.

An upper end of the main shaft 68 is connected to a roller driving motor, which is not shown, disposed at a main body side via a coupling.

The partition member 52 is provided with guiding parts 72A to 72C which guide the paper P and are disposed above and below the uppermost pair of rollers 62 and above the lowermost pair of rollers 62.

The partition member 52 upstream in the conveyance direction and the partition member 52 downstream in the conveyance direction are substantially symmetrically shaped except for a difference of positions at which the blade support members 58 are attached.

Each of a first step portion 74 and a second step portion 76 is formed on both sides of the partition 50 in the washing tank 26.

In the upstream side of the washing tank 26 of the partition 50, the width (horizontal direction of the paper in FIG. 1) and depth (left and right directions of the paper in FIG. 1) of a lower side of the first step portion 74 are set to be smaller than the width and the depth of an upper side of the first step portion 74, and the width and the depth of a lower side of the second step portion 76 are set to be smaller than the width and the depth of an upper side of the second step portion 76.

The first step portion 74 and the second step portion 76 are each level in the present embodiment of the invention. A seal member 82 having a predetermined thickness and made from an elastic material is fixed to each step portion by, for example, screwing.

The side wall 52C and the side wall 52D of the partition members 52 are held by positioning members 91 provided on an internal surface of the washing tank 26. A lower surface of the side wall 52C is contacted closely with the seal member 82 of the first step portion 74 and a lower surface of the side wall 52D is contacted closely with the seal member 82 of the second step portion 76.

As shown in FIG. 1, when the two partition members 52 are inserted into the washing tank 26 and held, a first processing chamber 90, a second processing chamber 92, a third processing chamber 94, a fourth processing chamber 96 and a fifth processing chamber 98 are formed independently in the washing tank 26.

Figure 5:
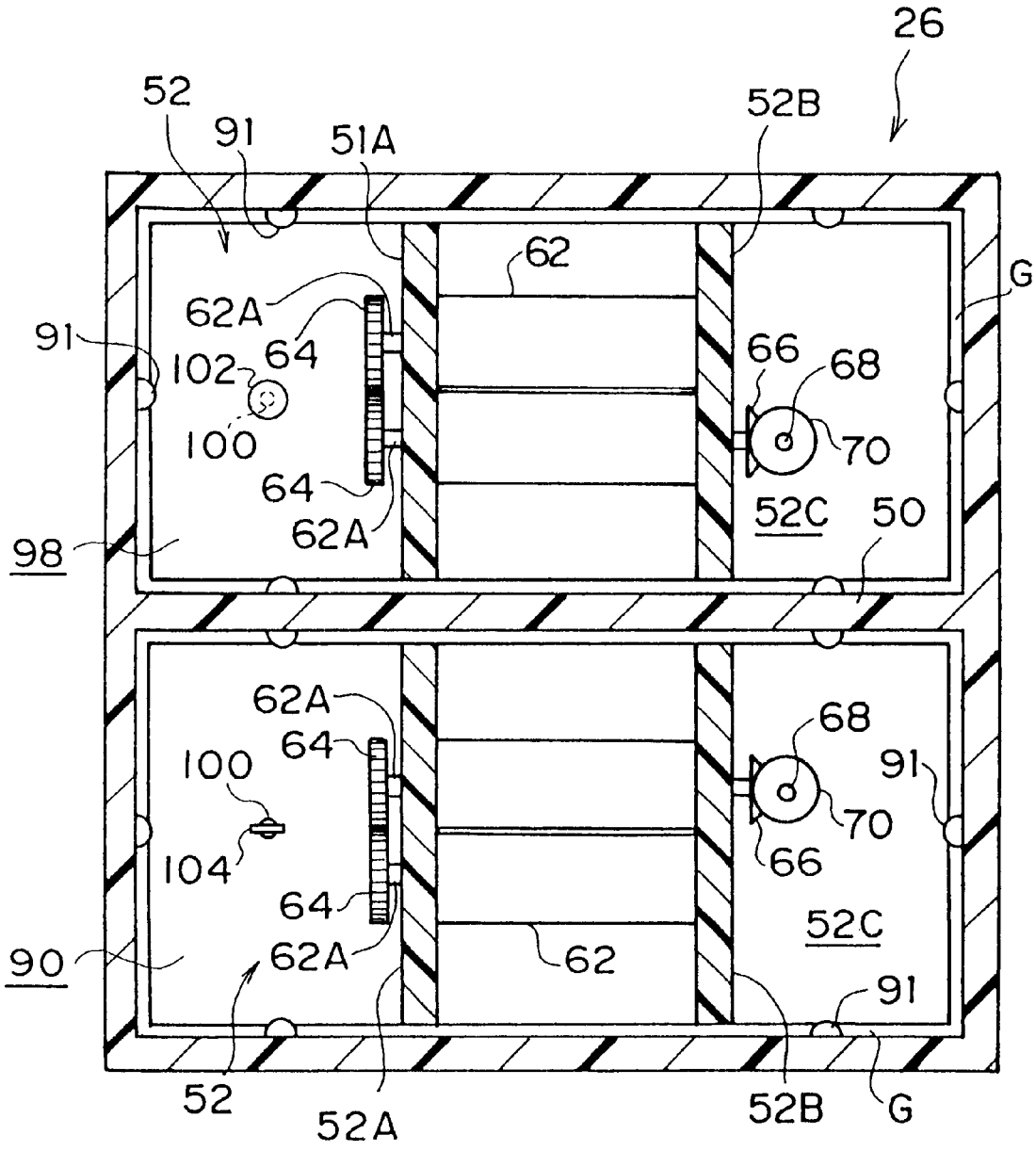
FIG. 5 is a cross-sectional view taken along line 5—5 of FIG. 1.

As shown in FIG. 3 to FIG. 5, each side wall 52C and each side wall 52D is provided with a through hole 100 which penetrates vertically therethrough. An area around the through hole 100 of the wall serves as a valve seat of a check valve.

The through hole 100, which communicates the first processing chamber 90 and the second processing chamber 92 and the through hole 100 communicating between the second processing chamber 92 and the third processing chamber 94, are provided with a synthetic resin valve body 102 forming the check valve.

The specific gravity of the valve body 102 is set to be larger than that of the washing water. When A is a specific gravity of the valve body 102 and B is a specific gravity of the washing water stored in the processing chamber that is upstream relative to conveyance direction of the photosensitive material, A/B is set to be at least 1 and less than 1.5.

Examples of a material of the valve body 102 include, vinyl chlorides (specific gravity is 1.40 to 1.41), acrylics (specific gravity is 1.2), and polycarbonates (specific gravity is 1.2).

The valve body 102 can be made from not only a single material but also from a plurality of materials. For example, a material having a high specific gravity, such as metal, may be imbedded in the valve body 102 to adjust the specific gravity.

In the embodiment of the invention, a mixture (having a specific gravity of 1.17) of polypropylene and vinyl chloride at about a 1:1 ratio is used for the material of the valve body 102.

Figure 6A:
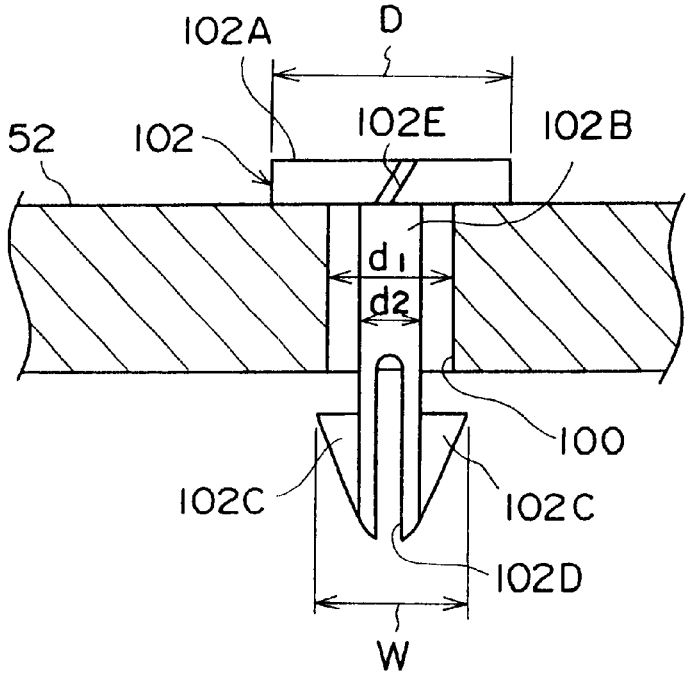
FIG. 6A is a cross-sectional view of a check valve according to an embodiment of the invention.
Figure 6B:
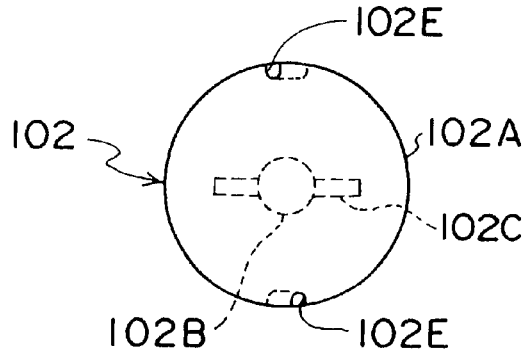
FIG. 6B is a plan view of the check valve.
Figure 6C:
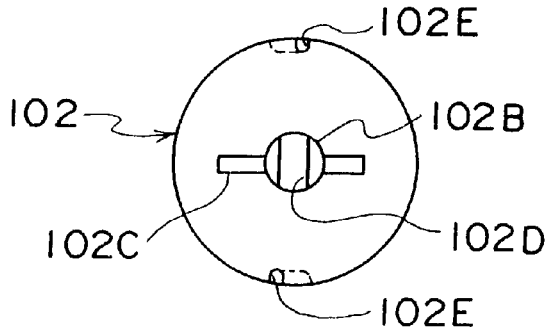
FIG. 6C is a bottom view of the check valve.

As shown in FIG. 6A, FIG. 6B and FIG. 6C, the valve body 102 includes a disc-shaped valve body 102A placed on the upper side of the through hole 100 and a shaft 102B which projects from the center of the valve body 102A and is inserted into the through hole 100.

A triangle-shaped stopper 102C is formed on both sides of a portion of the shaft 102B protruding from the bottom side of the through hole 100, and a notch 102D is formed between the stoppers 102C.

An outer diameter D of the valve body 102A is set to be sufficiently larger than an inner diameter $d_1$ of the through hole 100 in order to close the through hole 100.

An outer diameter $d_2$ of the shaft 102B is set to be smaller than an inner diameter $d_1$ of the through hole 100 so that the washing water flows easily therethrough.

A distance W between an outermost portion on one side of the stopper 102C and an outermost portion on the other side of stopper 102C is set to be slightly larger than the inner diameter $d_1$ of the through hole 100 so as to prevent the valve body 102 from coming out of the through hole 100.

In the valve body 102, since the notch 102D is formed in the shaft 102B, when the stopper 102C is inserted downward from an upper side of the through hole 100, a tip portion of the shaft is deformed elastically, which permits both of the stoppers 102C to be positioned below the through hole 100 as shown in FIG. 6A.

A pair of notches 102E, which is inclined in the shaft direction, is formed in an outer periphery portion of the valve body 102A.

A synthetic resin valve body 104 is attached to the through hole 100, which communicates the third processing chamber 94 and the fourth processing chamber 96, and the through hole 100, which communicates the fourth processing chamber 96 and the fifth processing chamber 98.

The valve body 104 has the same shape as the above described valve body 102, however a specific gravity of the valve body 104 is set to be smaller than that of the washing water. When A is the specific gravity of the valve body 104 and B is the specific gravity of the washing water stored in the processing chamber that is upstream relative to conveyance direction of the photosensitive material of the through hole 100, A/B is set to be at least 0.8 and less than 1.

Examples of a material to be used for the valve body 104 include, polypropylenes (having a specific gravity of 0.91) and polyethylenes (having a specific gravity of 0.91).

A space may be formed in the valve body 104 to adjust the specific gravity.

In the embodiment of the invention, the material of the valve body 104 is polypropylene, and the specific gravity of the valve body 104 is adjusted to 0.8 by providing an air cell therein.

The valve bodies 104 attached to the through hole 100, which communicates the third processing chamber 94 and the fourth processing chamber 96, and the through hole 100, which communicates the fourth processing chamber 96 and the fifth processing chamber 98 are attached in the reverse direction from the valve bodies 102.

As shown in FIG. 1, a replenishment device 105, which supplies fresh washing water, is provided in the washing tank 26 in the present embodiment according to the invention.

The replenishment device 105 includes a washing water tank 106 that stores the washing water and a pump 108 that supplies the washing water in the washing water tank 106 to the fifth processing chamber 98.

The photosensitive material processor 10 includes a control device, which is not shown, for computing a processed area of the paper P from the width and a quantity of the paper P conveyed. The control device is constructed to drive the pump 108 according to the processed area and replenish automatically the washing water according to the processed area.

One end of an overflow pipe 110 for discharging excess washing water to a waste water tank, which is not shown, is provided in the first processing chamber 90.

(Operation)

An operation of the photosensitive material processor 10 according to the present embodiment of the invention will now be described.

The paper P, which has been supplied from a paper magazine and has had a latent image formed thereon by an exposing section, enters the color developing tank 22 via a slit 36.

The paper P, which has entered into the color developing tank 22 is conveyed by the conveying device 42 to be color developed by the color developing solution. Then the color developed paper P enters into the bleach-fixing tank 24.

The paper P, which has entered into the bleach-fixing tank 24, is conveyed horizontally by the conveying device 48 through the bleach-fixing solution to be bleach-fixed thereby.

The paper P that is conveyed out from the bleach-fixing tank 24 is conveyed by a pair of rollers 62 into the first processing chamber 90 to be washed by the washing water.

Then, a leading edge of the paper P elastically deforms the blade 60, and the paper P passes between the blade 60 and a wall surface of the slit hole 58A to enter into the second processing chamber 92.

At this point, the paper P is urged against the wall surface of the slit hole 58A by the elastic force of the blade 60. This causes the upper surface and the lower surface of the paper P to contact the blade 60 and the wall surface of the slit hole 58A respectively and to be conveyed while sliding. Consequently, washing water of a processing chamber of on the upstream side adherent to the paper P is substantially not brought into a processing chamber on the downstream side.

Moreover, when the paper P finishes passing, an end of the blade 60 elastically presses against the wall surface of the slit hole 58A to isolate the first processing chamber 90 from the second processing chamber 92.

After that, in the same way as described above the paper P passes through the third processing chamber 94, the fourth processing chamber 96 and the fifth processing chamber 98 in sequence and washing is performed by each of the washing waters stored inside the processing chambers 94, 96 and 98.

The washed paper P is discharged to the product stocking portion 32 after being dried with warm air by a drying device 28.

As processing progresses to a certain extent, the washing water in the first processing chamber 90 is deteriorated by the bleach-fixing solution brought from the bleach-fixing tank 24 and the specific gravity of the washing water in the first washing tank 90 is increased by a content of the bleach-fixing solution.

When the specific gravity of the washing water in the first processing chamber 90 located at the upper side of the washing tank 26 becomes larger than that of the washing water in the second processing chamber 92 located at the lower side in the washing tank 26, the deteriorated washing water, which has a larger specific gravity, in the first processing chamber 90 tends to flow to the washing water that has a smaller specific gravity, which is stored in the lower second processing chamber 92. However, the valve body 102, which has a larger specific gravity than the washing water remains sunk in the washing water. Thus, the valve body 102A is urged by the force generated by the difference of the specific gravity between the valve body and the washing water in a direction preventing the processing solution from flowing, namely, downward, which causes the valve body 102A to close the through hole 100 and prevent the washing water from flowing backward. Accordingly, the washing water in the second processing chamber 92 is prevented from deteriorating.

As the processing further progresses, the specific gravity of the washing water in the second processing chamber 92 becomes larger than that of the washing water in the third processing chamber 94. However, in the same way as described above, the washing water in the third processing chamber 94 can be prevented from deteriorating by the function of the valve body 102 between the second processing chamber 92 and the third processing chamber 94.

Because the valve body 104, which is provided to the through hole 100 between the third processing chamber 94 and the fourth processing chamber 96, and the valve body 104, which is provided to the through hole 100 between the fourth processing chamber 96 and the fifth processing chamber 98, have a smaller specific gravity than the specific gravity of the washing water, a force (buoyancy) is generated by the difference in specific gravity between the valve body 104 and the washing water. This causes the valve body 104A to be urged in a direction to prevent the processing solution to flow, namely, upward. Accordingly the valve body 104A closes the through hole 100 to prevent the washing water from flowing backward.

In the third processing chamber 94, the fourth processing chamber 96 and the fifth processing chamber 98, the specific gravity of the washing water in the lower processing chamber becomes larger than that of the washing water in the upper processing chamber as the processing progresses. However, in contrast to the first processing chamber 90, the second processing chamber 92 and the third processing chamber 94, even if a difference in the specific gravity of the processing solution occurs between the processing chambers when the washing water having the larger specific gravity is below the washing water having the smaller specific gravity, the washing water does not flow backward.

When the processing capacity of the washing water declines, the control device drives the pump 108 according to the computed processed area of the paper P and supplies the washing water to the fifth processing chamber 98.

Figure 7:
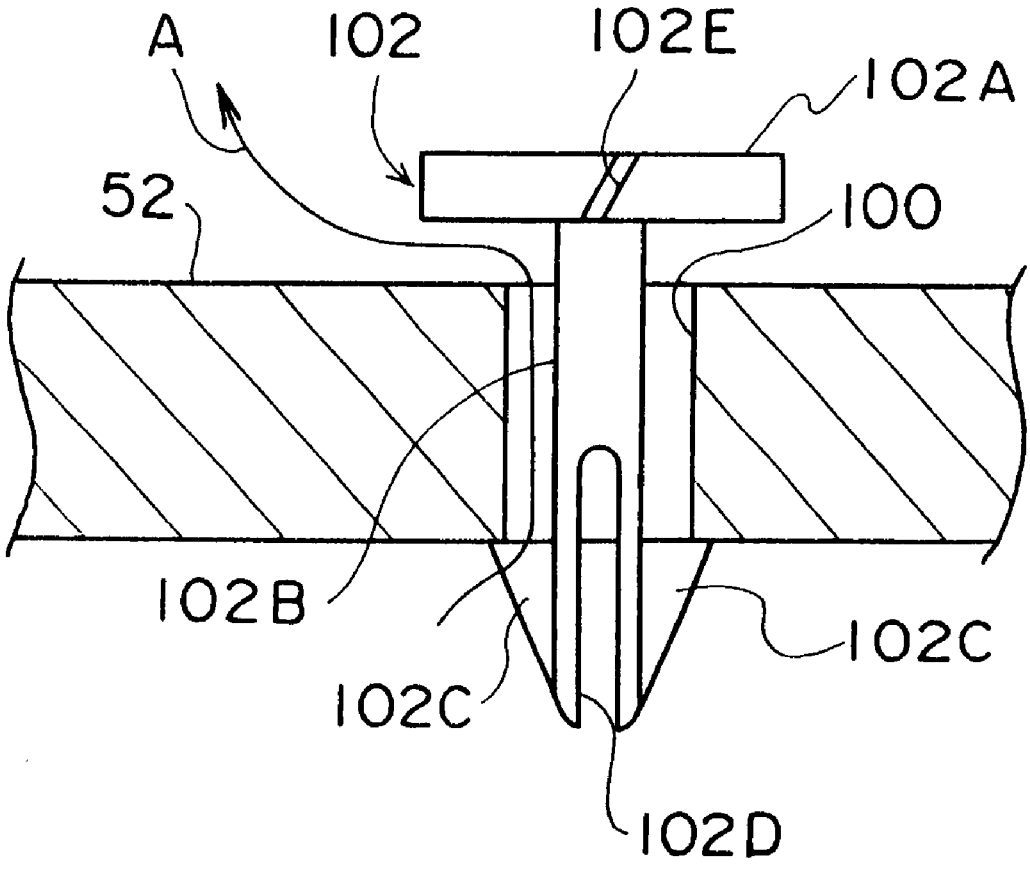
FIG. 7 is a cross-sectional view of a check valve showing washing water flowing through a through hole.

As a result, a liquid level of the fifth processing chamber 98 becomes higher than the liquid level of the first processing chamber 90, generating a difference in pressure between the fifth processing chamber 98 and the first processing chamber 90. This difference in pressure between the processing chambers causes the valve body 102 to move upward as shown in FIG. 7 (the valve body 104 moves downward), allowing the washing water to flow through the through hole 100 as shown by an arrow A in FIG. 7. Therefore, the washing water flows from the fifth processing chamber 98 to the first processing chamber 90 in sequence to recover the processing capacity of the washing water.

Excess washing water in the first processing chamber 90 is discharged to a waste water tank, which is not shown, through the overflow pipe 110.

As described above, the construction of the photosensitive material processor 10 according to the embodiment of the invention is simple because it is not necessary to provide a pump to each processing chamber to supply the washing water to each processing chamber.

When the washing water flows backward to the processing chamber, which is downstream relative to conveyance direction of the photosensitive material, by the generation of a difference in the specific gravity between the processing chambers, the valve body 102 is rotated with a rotating force generated by an effect of slanted water flow, which flows into the notch 102E formed at the outer peripheral portion of the valve body 102A and inclined in the axial direction thereof. This prevents the valve body 102 from not closing the through hole 100 because of being caught in the through hole 100. Though, in the embodiment of the invention, the notch 102E is formed at the outer periphery of the valve body 102A so as to rotate the valve body 102, the valve body 102 can also be rotated by a slanted hole formed in the valve body 102A or a propeller attached to the valve body 102.

In the photosensitive material processor 10 according to the embodiment of the invention, it is not necessary to install pipes outside of the processing chambers because each processing chamber communicates by the through hole 100 for passing sequentially the supplied washing water therethrough. As a result, the number of parts of the photosensitive material processor 10 does not increase and the cost can be reduced.

Figure 8:
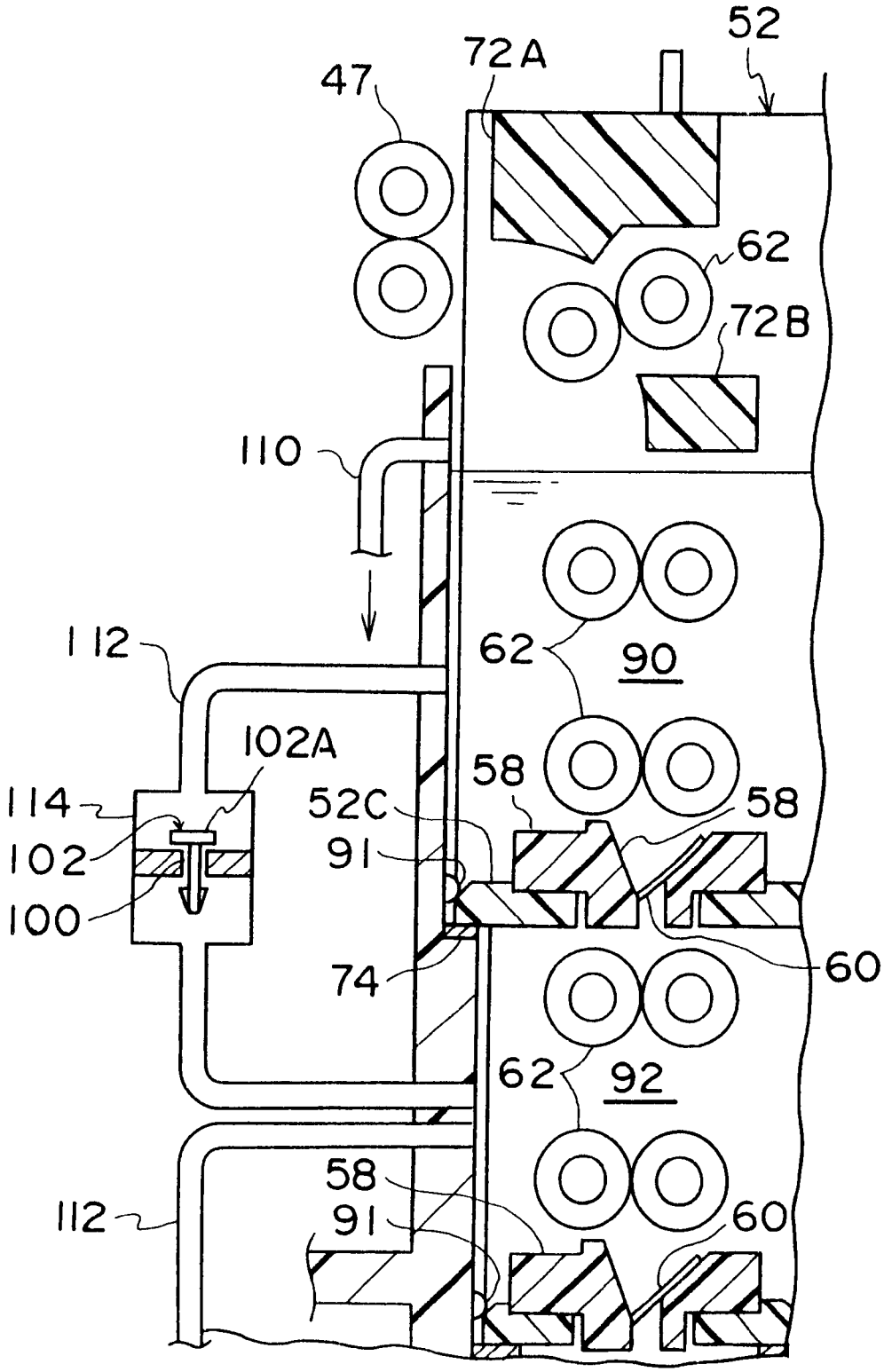
FIG. 8 is a cross-sectional view of necessary parts of a washing tank in a photosensitive material processor according to another embodiment of the invention.

Alternately, depending on the case, an upper processing chamber and a lower processing chamber may be adapted, for example, as shown in FIG. 8, the first processing chamber 90 and the second processing chamber 92, communicate by the piping 112, and an auxiliary chamber 114 including the through hole 100 and the valve body 102 is arranged in the piping 112.

Figure 9A:
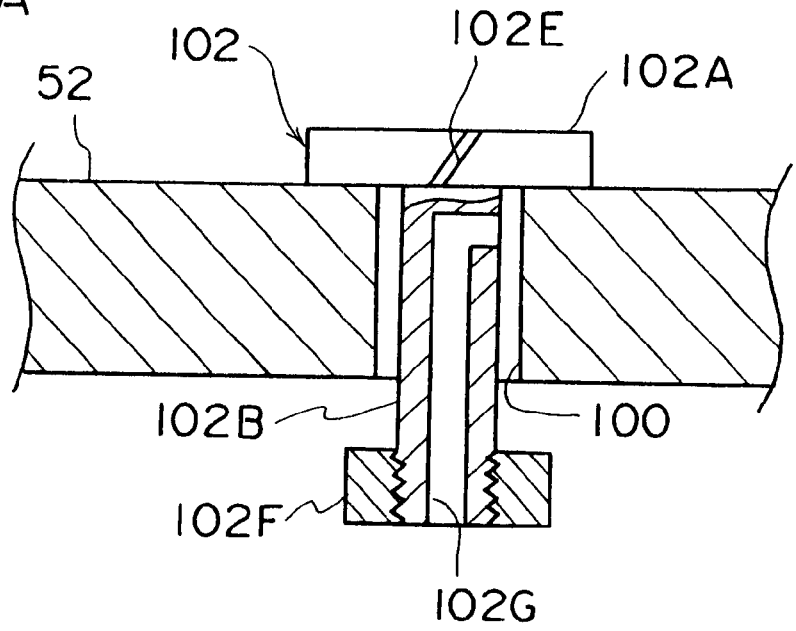
FIG. 9A is a cross-sectional view of a check valve showing a flow of washing water in a stopped state in a photosensitive material processor according to the other embodiment of the invention.
Figure 9B:
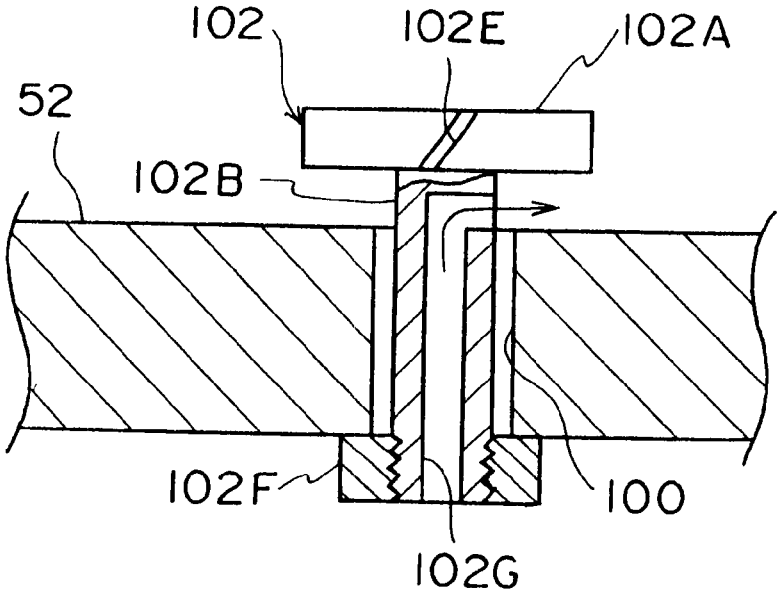
FIG. 9B is a cross-sectional view of a check valve showing washing water to be flowing.

The valve body 102 is not limited to the shape shown in FIG. 6, and may be other shapes, for example, as shown in FIG. 9A and FIG. 9B.

In the valve body 102 shown in FIG. 9A and FIG. 9B, a disk-shaped stopper 102F is fixed by a screw to an end of a shaft 102B. Further, a path 102G of washing water is formed in the shaft 102B.

In the valve body 102, the valve body 102A usually closes the through hole 100 as shown in FIG. 9A. When supplying the washing water the valve body 102A is lifted as shown FIG. 9B, which permits the washing water to flow through the path 102G.

The valve body 104 may be the same shape as the valve body 102 shown in FIG. 9A and FIG. 9B.

As explained above, construction of the photosensitive material processor according to the invention makes the structure simple and capable of processing quickly without the processing solution flowing backward.

What is claimed is:

1. A device for processing a photosensitive material using processing solution, the device comprising:

a plurality of processing chambers for storing processing solution therein, at least one of the processing chambers being lower than another processing chamber, paths connecting each processing chamber to another, a blade disposed at the path for permitting the photosensitive material to pass along the path by deforming resiliently and for inhibiting passage along the path of the processing solution in the processing chamber when the photosensitive material is not passing, a conveyance mechanism for conveying the photosensitive material through the processing chambers, a replenishment device for replenishing the processing solution, in accordance with a processed quantity of the photosensitive material, to at least one processing chamber that is downstream of another chamber relative to conveyance direction of the photosensitive material, a bypass for placing each processing chamber that is downstream of another processing chamber relative to conveyance direction of the photosensitive material in fluid communication with said another processing chamber for passage of the processing solution therethough, and a check valve disposed at each bypass for allowing the processing solution which flows from said processing chamber that is downstream relative to conveyance direction of the photosensitive material to said another processing chamber, and for preventing the processing solution from flowing from said another processing chamber to said downstream processing chamber, the check valve comprising a valve seat and a valve body, the valve body has a specific gravity different from a specific gravity of the processing solution and is urged against the valve seat by a force generated by the difference of specific gravity between the valve body and the processing solution.

2. The device according to claim 1, wherein the valve seat is disposed below the valve body in the check valve provided between the processing chambers through which the photosensitive material is conveyed downwards.

3. The device according to claim 2, wherein the valve seat is arranged above the valve body in the check valve disposed between the processing chambers in which the photosensitive material is conveyed upwards.

4. The device according to claim 3, wherein when replenishing the processing solution, A is specific gravity of the valve body disposed at the bypass through which the processing solution flows upward and B is specific gravity of the processing solution stored in the processing chamber that is upstream of the bypass relative to conveyance direction of the photosensitive material, whereas A/B is set to be at least 1 and less than 1.5.

5. The device according to claim 3, wherein when replenishing the processing solution, A is specific gravity of the valve body disposed at the bypass through which the processing solution flows downward and B is specific gravity of the processing solution stored in the processing chamber that is upstream of the bypass relative to conveyance direction of the photosensitive material, whereas A/B is set to be at least 0.8 and less than 1.

6. The device according to claim 5, wherein the bypass comprises an auxiliary chamber disposed in a pipe, the auxiliary chamber includes a through hole, and the valve body is provided at the through hole.

7. The device according to claim 5, wherein the bypass is a through hole formed in a partition separating the processing chamber that is downstream relative to conveyance direction of the photosensitive material from the processing chamber that is upstream relative to conveyance direction of the photosensitive material.

8. The device according to claim 7, wherein the valve body includes a rotatable mechanism rotated by the processing solution flowing near the valve body.

9. The device according to claim 8, wherein the check valve includes a shaft portion and a disk-shaped stopper, and a path through which the processing solution passes is formed in the shaft portion.

10. The device according to claim 8, further comprises a control device for calculating a processed area of the photosensitive material and for controlling the replenishment device according to said processed area.

11. A device for processing a photosensitive material using processing solution, the device comprising:

a plurality of processing chambers for storing processing solution therein, at least one of the processing chambers being lower than another processing chamber, paths connecting each processing chamber to another, a blade disposed at the path for permitting the photosensitive material to pass along the path by deforming resiliently and for inhibiting passage along the path of the processing solution in the processing chamber when the photosensitive material is not passing, a conveyance mechanism for conveying the photosensitive material through the processing chambers, a replenishment device for replenishing the processing solution, in accordance with a processed quantity of the photosensitive material, to at least one processing chamber that is downstream of another chamber relative to conveyance direction of the photosensitive material, a bypass for placing each processing chamber that is downstream of another processing chamber relative to conveyance direction of the photosensitive material in fluid communication with said another processing chamber to pass the processing solution therethough, and a check valve disposed at each bypass for allowing the processing solution to flow from said processing chamber that is downstream relative to conveyance direction of the photosensitive material to said another processing chamber, and for preventing the processing solution from flowing from said another processing chamber to said downstream processing chamber, wherein the plurality of processing chambers is disposed such that the photosensitive material is conveyed downwards through at least one of the processing chambers that is lower after being conveyed through the another processing chamber and then is conveyed upward through at least one other processing chamber higher than the lower chamber, the check valve disposed between the processing chambers, through which the photosensitive material is conveyed from the higher to the lower processing chamber, comprises a valve seat and a valve body, the valve seat being disposed under the valve body, the valve body having a specific gravity greater than a specific gravity of the processing solution and being urged against the valve seat by a force generated by the difference in specific gravity between the valve body and the processing solution; and the check valve being disposed between the processing chambers through which the photosensitive material is conveyed from the lower to the higher processing chamber, comprises a valve seat and a valve body, the valve seat being disposed above the valve body, the valve body having a specific gravity less than a specific gravity of the processing solution and being urged against the valve seat by a force generated by the difference in specific gravity between the valve body and the processing solution.

12. The device according to claim 11, wherein when replenishing the processing solution, A is specific gravity of the valve body disposed at the bypass through which the processing solution flows upward and B is specific gravity of the processing solution stored in the processing chamber that is upstream of the bypass relative to conveyance direction of the photosensitive material, whereas A/B is set to be at least 1 and less than 1.5.

13. The device according to claim 11, wherein when replenishing the processing solution, A is specific gravity of the valve body disposed at the bypass through which the processing solution flows downward and B is specific gravity of the processing solution stored in the processing chamber that is upstream of the bypass relative to conveyance direction of the photosensitive material, whereas A/B is set to be at least 0.8 and less than 1.

14. The device according to claim 13, wherein the bypass comprises an auxiliary chamber disposed in a pipe, the auxiliary chamber includes a through hole, and the valve body is provided at the through hole.

15. The device according to claim 13, wherein the bypass is a through hole formed in a partition separating the processing chamber that is downstream relative to conveyance direction of the photosensitive material from the processing chamber that is upstream relative to conveyance direction of the photosensitive material.

16. The device according to claim 15, wherein the valve body includes a rotatable mechanism rotated by the processing solution flowing near the valve body.

17. The device according to claim 16, wherein the check valve includes a shaft portion and a disk-shaped stopper, and a path through which the processing solution passes is formed in the shaft portion.

18. The device according to claim 16, wherein the photosensitive material processor further comprises a control device for calculating a processed area of the photosensitive material and for controlling the replenishment device according to said processed.

* * * * *